United States Patent [19]

Moe

[11] 4,018,100

[45] Apr. 19, 1977

[54] SELECTION CONSOLE AND LOCKING MECHANISM FOR VENDING MACHINE

[76] Inventor: James A. Moe, 503 Carolyn Lane, White Bear Lake, Minn. 55110

[22] Filed: Aug. 20, 1975

[21] Appl. No.: 606,163

[52] U.S. Cl. ..... 74/483 PB; 194/10; 200/5 EA

[51] Int. Cl.[2] ..... G05G 5/08; G05G 13/02

[58] Field of Search ..... 74/483 PB; 200/5 E, 200/5 EA, 5 EB; 194/10

[56] References Cited

UNITED STATES PATENTS

| | | | |
|---|---|---|---|
| 2,192,621 | 3/1940 | Radtke | 74/483 PB X |
| 2,378,073 | 6/1945 | Felver et al. | 74/483 PB X |
| 2,451,150 | 10/1948 | Brian | 74/483 PB X |
| 2,581,218 | 1/1952 | Thompson | 74/483 PB |
| 2,875,877 | 3/1959 | Hoban | 194/10 |
| 2,973,664 | 3/1961 | Williams | 74/483 PB |
| 3,395,590 | 8/1968 | Williams | 74/483 PB |

*Primary Examiner*—Allan D. Herrmann
*Attorney, Agent, or Firm*—John C. Barnes

[57] ABSTRACT

The selection console of the present invention affords a plurality of finger-actuated push buttons which move a short distance to actuate the item-selecting mechanism of a vending machine. The console utilizes a single solenoid to unlock the selector mechanism in response to the energization of the coin accumulator and price mechanism and actuation of a selection price switch. Further, the machine permits the items in the vending machine to be priced at different values without the necessity of separate mechanisms, except for a switch to be actuated by each price bar. Once a price has been selected, the locking mechanism of the console of this invention prohibits one from changing to a different item.

11 Claims, 8 Drawing Figures

SELECTION CONSOLE AND LOCKING MECHANISM FOR VENDING MACHINE

BACKGROUND OF THE INVENTION

1. Field of the Invention

This invention relates to improvements in selector consoles for vending machines, and in particular, to an improved multipriced vending machine operating console and in one aspect, to an improved operating mechanism for a vending machine with a plurality of differently priced items to reduce the electrical components.

2. Description of the Prior Art

The present invention has as one aspect a novel machine-operating mechanism using push buttons having limited travel and a locking system which protects against multiple operations of the machine. Further, the present invention permits multiple pricing without the need of separate electrical components for actuating each selection from the vending machine or for each selection bar or item dispensing column of the machine.

In most prior art devices the coin detector energizes the vending machine such that the machine is ready for the operator to make a selection. The machine is energized and operation of any article selector button will energize a particular relay to actuate the vending machine to dispense the selected item. Such a system is illustrated in U.S. Pat. No. 2,875,877, issued Mar. 3, 1959 to F. W. Hoban. Vending machines of this type for push-button selection utilize a large number of electrical components and thereby increase the machine cost due to their cost. Further, with a large number of electrical components it is more difficult to repair where the faulty item cannot be readily identified.

The present invention is directed to an improvement over the previous mechanical push button selection system in that the amount of travel of the selector is reduced, the selector is locked such that upon beginning of the depression of a selector button through as little as ⅛ inch the selection is determined, since the maximum stroke of the button is ⅝ inch. Further, once this button starts to move, the novel "locking cross" of the present invention prohibits return of the button and actuation of a second button to either dispense more than one item or to dispense a more expensive item from the machine.

SUMMARY OF THE INVENTION

The present invention is directed to a module forming the selecting console for a vending machine. This console comprises a plurality of selector buttons reciprocating along parallel axes. A conventional locking bar is actuated to prevent the movement of more than one button in the direction of the operating cycle. Operation of a selection button locks out the other buttons by pivoting a slotted locking bar, extending along the row of buttons, into their path. A novel "locking cross" restricts movement of the buttons until proper energization of the machine by the coin detector and accumulator and corresponding price switch. Actuation of a solenoid by the coin accumulator and price switch energizes the machine to permit actuation through one cycle of operation. The vending machine is cycled by operation of the solenoid to shift a novel "locking cross" which has locking means cooperating with detents on a slide bar moved upon the actuation of a button. Operation of a button, preferably a push button, immediately operates the pivoting locking bar and a price bar. The price bar, when moved by the push button, actuates a price switch to energize the solenoid and actuate the locking cross to permit movement of the slide. Once the slide is moved, the cycle of operation must be continued because the slide will not return until it is moved from the first rest position to a predetermined second position at which the vending cycle is completed and the locking cross returns to its normal position. The price bars are stacked on the rear of the console and have depending arms. Each price bar may have one or more arms depending toward the push buttons to be operated thereby. If two or more prices for the items in the machine are desired there will be two or more price bars. All items in the vending machine having the same price will have an arm extending downward to the selector button from that price bar. Actuation of any one of the buttons against an arm will thus operate the switch associated with that price bar and no other.

DESCRIPTION OF THE DRAWING

The present invention will be more fully understood after consideration of the accompanying drawing wherein.

DETAILED DESCRIPTION OF THE PRESENT INVENTION

Figure 1:
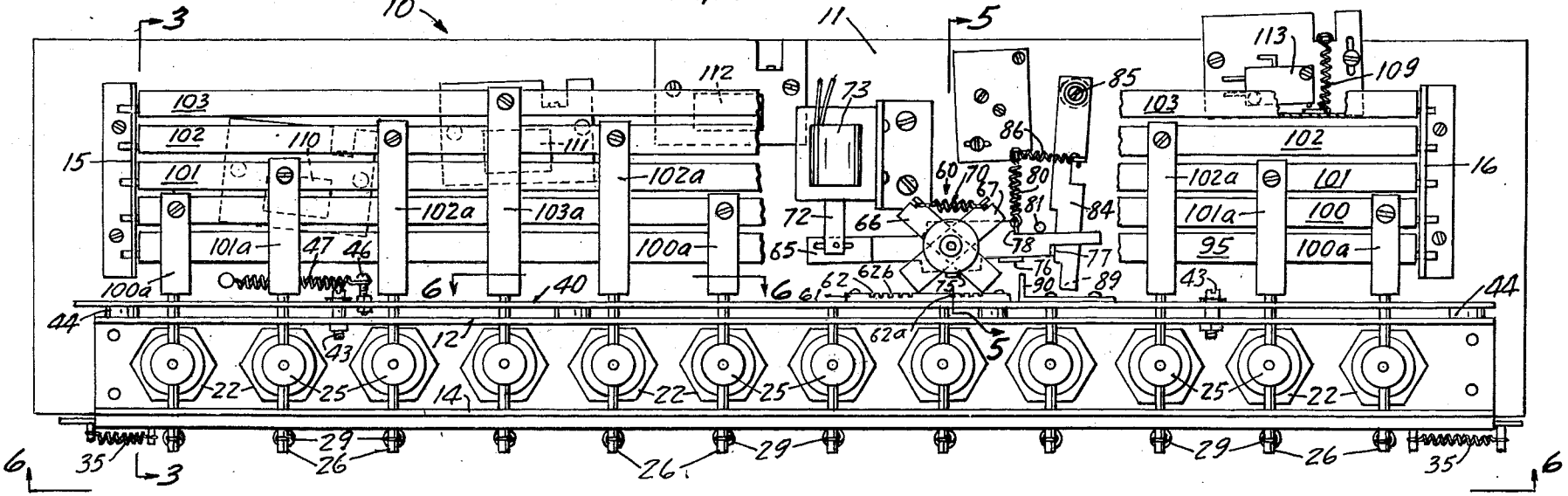
FIG. 1 is a rear elevational view of the selector module of the present invention having portions thereof broken away to show interior members.

The present invention is adapted to mechanically actuate a reciprocable actuating rod of a vending machine to cause the tripping of a shelf and the dispensing of an item from the vending machine. A vending machine adapted for use with the selector module of the present invention is illustrated in U.S. Pat. No. 3,813,005, issued May 28, 1974 to J. A. Moe and T. J. Ross. The module of the present invention however may also be utilized with other vending machines utilizing a reciprocating bar to trip the shelves in the machine. The module of the present invention substantially reduces the number of electrical components in a vending machine having multiple prices and thereby reduces the cost and maintenance time of such equipment.

The selecting module of the present invention is generally indicated by a reference numeral 10, and includes a front support panel 11 having on the rear thereof rearwardly extending horizontal support shelves 12 and 14, and vertically disposed and rearwardly extending support walls 15 and 16. Supported through a plurality of openings 17 in the panel 11 are a plurality of push button assemblies 18, all of which are identical in construction and, as most clearly illustrated in FIGS. 2 and 3, comprise a sleeve 19 having a shoulder 20 abutting the panel 11 and a threaded collar 21 extending through the hole in the panel. Threaded on the collar 21 is a retaining nut 22 which is threaded and turned tightly up against the rear of the frame to maintain the shoulder 20 against the panel 11. Disposed within the sleeve 19 and the collar 21 is a push button having an enlarged end portion 24 and a shank 25 extending through the sleeve 19 and collar 21 and slidably fitted in the bore in the collar 21. Extending diametrically through a bore in the shank 25 is an actuating pin 26. This pin is fixed in the shank 25 of the push button 24 and extends through longitudinal slots 27 and 28 in the shelves 12 and 14 respectively. Thin pins 26 are normally positioned toward the forward end of these slots by a tension spring 29 connected to the lower end of the pin 26 and fixed at their opposite end to suitable retaining means in the forward end of the module beneath the panel 11. The opposite ends of the pins are formed with a recess 34 to reduce the thickness of the pin at its upper end to afford some travel of the pin as the button is pushed before the pin engages a stop. This travel is used to mechanically actuate a lock engaging the other pins before actuating a lock release mechanism as will be hereinafter described.

Secured to the lower surfaces of the shelf 14 are a pair of transversely extending spacing bars 30 and 31. The bars 30 and 31 extend longitudinally of the module but transversely or across the front of the vending machine. These bars are maintained in place by a plate 32 disposed beneath the spaced bars 30 and 31 and they also define a transversely extending slot in which is placed a plurality of steel plates forming locking elements 33. The locking elements 33 on each end of the slot have a pin extending downwardly therefrom to which is connected a spring 35 to bias all of the elements 33 toward the center such that the parting edges of the locking elements are normally disposed in line with slots 36 in the plate 32 and with the slots 28 in the shelf 14. These locking elements 33 are positioned such that when a pin 26 is moved along the slots 28 and 36 it will after slight travel cause the separation of two locking elements 33 and displace all of the locking elements on either side thereof such that there is no parting line between two elements any longer disposed in line with a slot in front of a different actuating pin 26.

Figure 2:
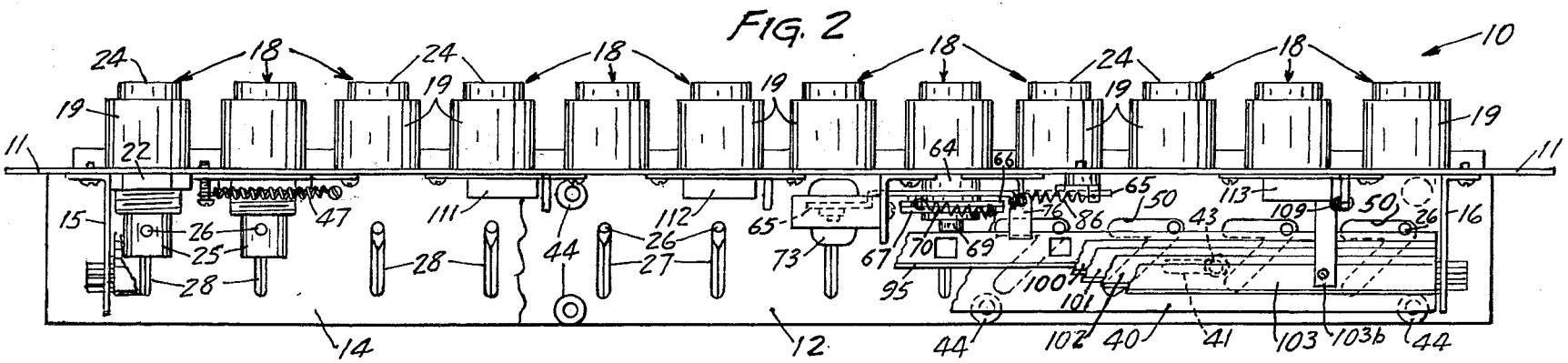
FIG. 2 is a plan view of the selector module having portions thereof broken away to show interior members.
Figure 5:
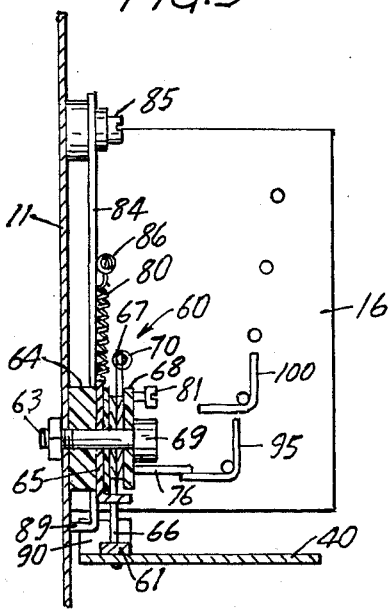
FIG. 5 is a fragmentary detailed sectional view of the locking mechanism of FIG. 4.

Disposed above the shelf 12 is a slide bar 40. The slide bar 40 has transversely extending slots 41 in which are received pins 43 to support the slide bar 40 on nylon posts 44. Connected also to the slide bar 40 are pins 46 to which are connected springs 47 urging the slide bar to a rest position to the left as shown in FIGS. 1 and 2.

Figure 7:
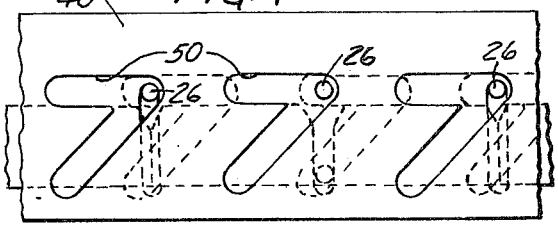
FIG. 7 is a detailed plan view of the slide bar taken at line 7—7 of FIG. 3.
Figure 6:
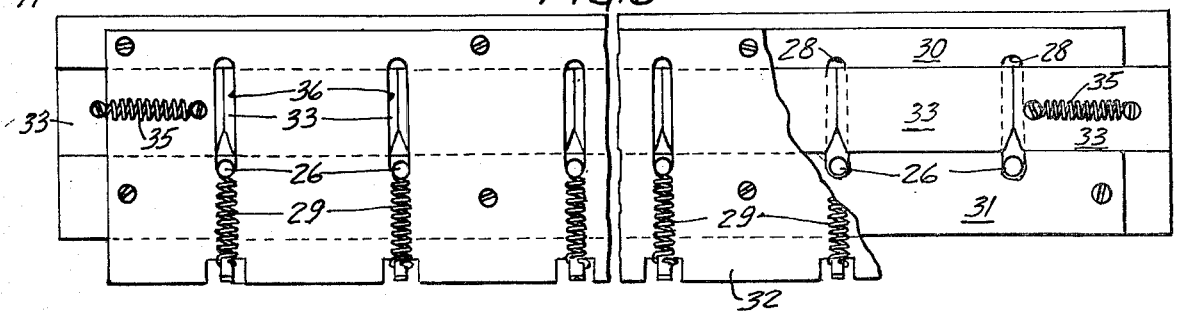
FIG. 6 is a fragmentary bottom view of the module illustrating the return springs for the buttons and the conventional locking system.

The slide bar 40 is also formed with a series of slots 50 shaped like a number 7. The transversely disposed section of the slot or the top of the number 7 is disposed generally in line with the forward end of the slot 27 in the shelf 12. Thus, as the slide bar 40 moves transversely, the transverse section of the slots 50 is aligned with the pins 26, providing a lost motion for the slide bar relative to the pins other than the one actuated and locking the pins. An individual pin 26, however, actuates the slide bar 40 by engaging the inclined rearwardly directed portion of a slot 50, as a pin 26 moves rearward in the slots 27 and 28, to move the slide bar 40 to the right as shown in FIGS. 1, 2 and 7. This movement is normally restricted due to a locking mechanism supported on the rear side of the panel 11 which restricts the movement of this slide bar. The locking mechanism is generally designated 60 in FIGS. 1, 2, 4 and 5.

Figure 4:
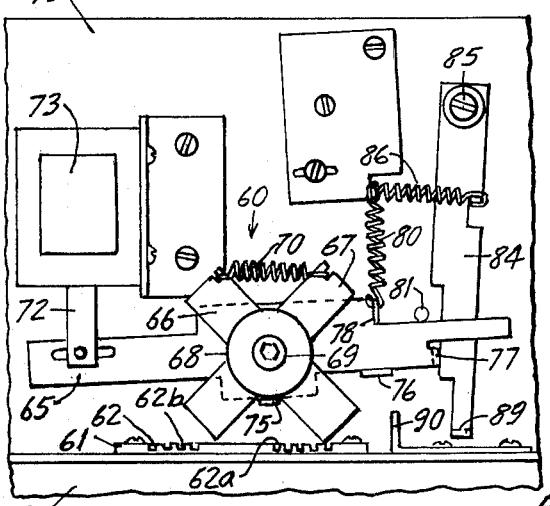
FIG. 4 is an enlarged detail elevational view of the slide bar locking mechanism.

The locking mechanism 60 includes a "locking cross" which is actuated by an ear to unlock the locking means for the slide bar 40, thereby permitting a pin 26 to move the slide bar at the beginning of the dispensing cycle and to engage a locking means which prevents the return of the slide bar until the cycle is completed. This locking mechanism comprises a locking bar 61 fixed to the slide bar 40 and having detent means 62 disposed on the upper surface of the slide bar 40. The locking means as shown in FIGS. 1 and 4 is supported on the panel 11 by a pin 63 which has thereon a spacer 64, an actuating bar 65, a pair of independent locking pawls including a first locking pawl 66 and a second pawl 67, and a second spacer 68. The spacer 68 is against the head of the pin 63. The actuating bar 65 and the locking pawls 66 and 67 are free to pivot on the pin 63. The first and second locking pawls have opposed ears at the upper ends thereof which are connected by a tension spring 70. The lower ends of the locking pawls have a square corner to define a pointed end which engages respectively the detents **62*a* and 62*b* on the locking bar 61. Means are provided for lifting one or the other of the locking pawls free from engagement with the detents 62*a* or 62*b* and this means is supported by the actuating bar 65** as hereinafter described.

The actuating bar 65 extends transversely in each direction from the pin 63. At one end of the actuating bar 65 is, see FIG. 1, a slot connected by a pin to the actuating rod 72 of an electrical solenoid 73. Intermediate the ends of the locking bar and disposed directly beneath the pin 63 is a rearwardly (of the machine) projecting ear 75 which is positioned between the pawls 66 and 67. The ear 75 always engages one or the other of the pawls due to the bias of spring 70 and the other pawl engages the slide bar 40. Any movement of the ear 75 may cause the ear 75 to release one pawl allowing it to move into locking position and lift the other out of locking position against the slide bar 40. It is not necessary to move a locking member overcenter or pivot a bar and there is not an interval of time or travel where the lock is disengaged from the slide bar. On the opposite end of the actuating bar 65 is a rearwardly projecting plate 76 and a vertically disposed and forwardly extending catch 77. To this end is also formed an ear 78 to which is connected one end of a spring 80 urging the locking bar to pivot counterclockwise on pin 63 as shown in FIG. 1 against the force of the solenoid 73 and against a stop 81. A vertically depending bar 84 is pivoted about a pin 85 and is urged by a spring 86 toward engagement with the catch 77. On the lower end of the bar 84 is a foot 89 positioned to be engaged by an upstanding lug 90 fixed to the slide bar 40. The lug 90 will move the bar 84 to release the catch 77 and permit the bar 65 to pivot to its counterclockwise position against stop 81 when the midpoint of the dispensing cycle is reached.

Extending between the transversely spaced brackets 15 and 16 is an angle bar defining a locking bar 95 which is formed with a plurality of rectangular holes 96 in the lower leg thereof as shown in FIG. 7 and FIG. 2.

A pair of pins, one supported at each end of this angle member, define a pivotal support for the bar 95 in a slot or opening in the walls 15 and 16. The plate 76 on the locking bar 65 engages the upper surface of the lower leg of the locking bar 95 and as the solenoid operates the actuating bar 65 the plate 76 causes the bar 95 to pivot toward the pins 26.

Figure 3:
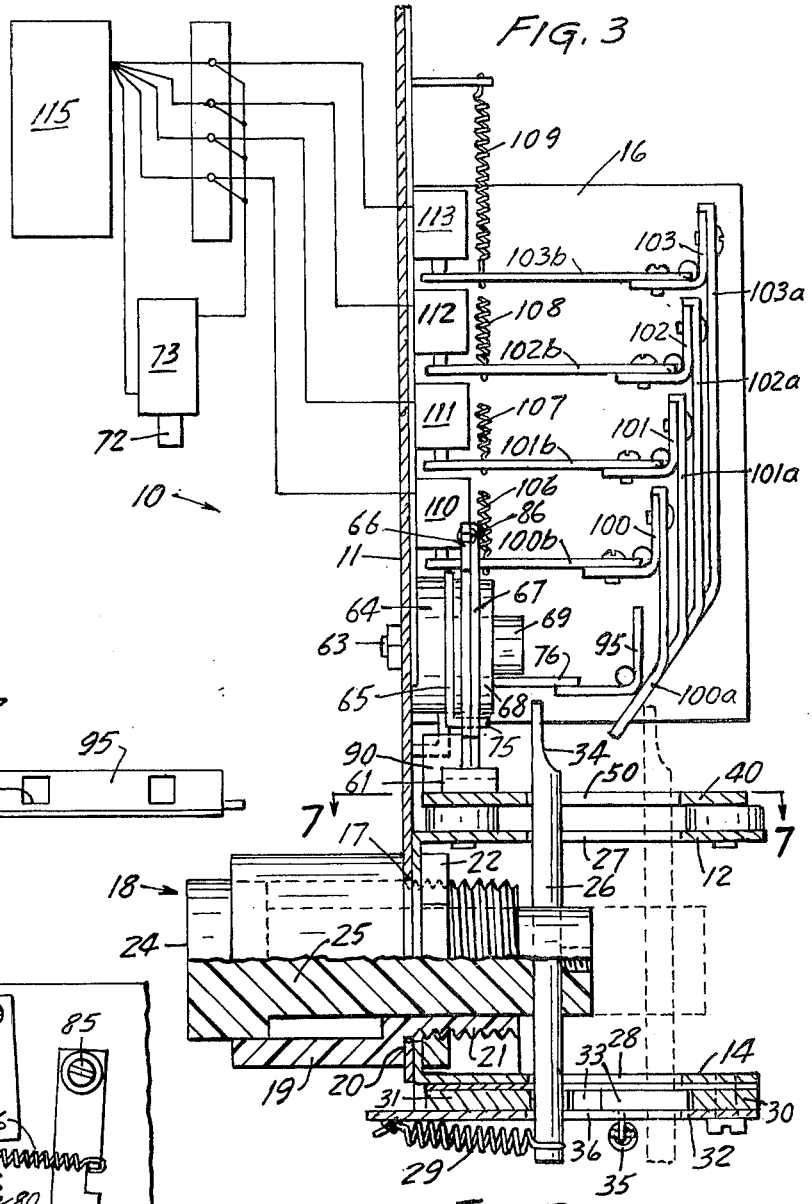
FIG. 3 is a vertical sectional view of the module taken along lines 3—3 of FIG. 1 and showing the electrical elements in a schematic diagram.
Figure 8:
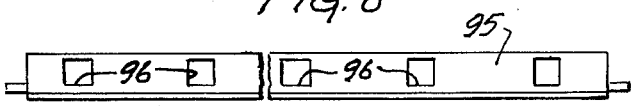
FIG. 8 is a fragmentary detailed view of the pivotable locking bar.

Extending parallel with the locking bar 95 and slightly rearwardly offset therefrom and spaced above the bar 95 are a plurality of price selecting bars 100, 101, 102 and 103. Each of these price selecting bars has pins at each end which extend through holes or slots in the frame members 15 and 16 to pivotally support these members. Each price selection bar has one or more depending arms identified respectively as 100*a*, 101*a*, 102*a* and 103*a*, positioned so as to be engaged by movement of the actuator pins 26 of the buttons 24. Each price selection bar also has a single forwardly extending switch actuating arm 100*b*, 101*b*, 102*b* and 103*b* as shown in FIG. 3.

Springs 106, 107, 108 and 109 are connected to the switch actuating arms 100*b*, 101*b*, 102*b* and 103*b* to urge them into contact with the switch actuating button of the cooperating switches 110, 111, 112 and 113. The arms thus maintain the switches opened until a pin 26 of a button assembly 18 moves rearward and engages a depending arm of a price selection bar causing the bar to pivot counterclockwise as shown in FIG. 3 against the bias of the spring 106, 107, 108 or 109 and the closing of the respective switch 110, 111, 112 or 113.

For example, price bar 102 has several depending arms 102*a*, see FIG. 1. When the coin accumulator and price mechanism 115 has been energized to close the circuit to switch 112 a button 24 may be pushed and the button will correspond to the selected price and a dispensing shelf with a certain article. The pin 26 will then engage the corresponding depending arm 102*a* thereby closing the switch 112. The recess 34 in the pin 26 allowed the pin to travel about ⅛ inch to cross the transverse portion of slot 50 of the slide bar 40, move toward an inclined portion of slot 50 and begin separation of the locking elements 33 before pivoting the price bar 102 by engaging an arm 102*a* with the recess 34. When switch 112 is actuated the pin 26 is then past the forward edge of bar 95. Switch 112 will then actuate the solenoid 73 to pivot the locking bar 65 to permit transverse travel of the slide bar 40 and plate 76 on bar 65 pivots the locking bar 95. Bar 95 pivots to stop any rearward movement of other pins 26, but the pin 26 being actuated is positioned in a slot 96 so it can continue to move rearward but not return as the slide bar 40 is locked against return by pawl 66 until the cycle is completed. Also bar 95 restricts the return of the pin 26.

The movement of the bar 65, via ear 75, raises the pawl 67 and lowers pawl 66 into engagement with detents 62*a* to prevent the return of the slide bar to the left until the slide bar 40 has been moved to the right sufficiently for lug 90 to engage foot 89 and move the bar 84 to the right and release the catch 77. At this point, the dispensing cycle is substantially midway. The shelf may have been released and the slide bar may be returned. During the return, the shelf may be completely released and the item will be dispensed from the machine. When the catch 77 is released, the actuating bar 65 turns counterclockwise and the locking bar 95 is released and returns to its normal position. As the actuated pin 26 returns to its normal position under the pressure of spring 29, the locking elements 33 return to their centered position.

The combined locking members including elements 33, bar 95 and pawls 66 and 67 with the slide bar 40 having the number 7 shaped slots 50, assure the precise operation of the module and operation is effectively controlled by the limited number of switches operated by the price bars which determine the number of differently priced items which may be in a single vending machine.

Having thus described the preferred embodiment, it will be understood that certain changes can be made without departing from the invention. For example, the button assemblies 18 could be replaced by pull knobs and reciprocating rods with perpendicular pins corresponding to pins 26. To make this substitution the other members would also have to be reversed in direction of operation etc.

What is claimed is:

1. In a selection console for a vending machine, the combination of a plurality of pins reciprocatably movable independently in parallel paths, a slide bar extending across and normal to said paths, said slide bar having a plurality of slots each receiving one of said pins, said slots having a surface to be engaged by a said pin to cause movement of said slide bar upon movement of a pin in a said path, means defining a plurality of detents spaced along said slide bar in the direction of movement thereof, an actuating member, a pair of pawls pivoted on an axis, means for biasing one of said pawls into engagement with said slide bar and the other of said pawls into engagement with said actuating member, said actuating member being movably supported relative to said pawls to pivot said one pawl to permit movement of said slide bar in only one direction during movement of a said pin in one direction and restrict movement of said slide bar in the other, and to shift said pawls to restrict movement of said slide bar in said one direction upon the return movement of said pin and slide bar.

2. In a selection console according to claim 1 wherein said combination further comprises a plurality of elongate parallel price bars which extend parallel to the direction of movement of said slide bar, means supporting said price bars for pivotal movement about axes parallel to said price bars, each said price bar having at least one arm extending generally normal to said axis and into the path of a said pin, a plurality of switches associated one with each price bar, each switch being actuated upon pivotal movement of the associated price bar about its axis, and means responsive to actuation of a said switch for moving said actuating member to pivot said one pawl.

3. In a selection console according to claim 1, the combination wherein said actuating member comprises a bar pivoted on the pivot axis of said pawls and having an ear on said bar positioned between said pawls at a position between said axis and said slide bar.

4. In a selection console according to claim 3 wherein said bar is connected to a solenoid to pivot said bar to a second position about said axis to shift said pwals affording movement of said slide bar in said one direction.

5. In a selection console according to claim 4 wherein said bar has a catch member to hold said bar in the second position until said slide bar has been moved in said one direction a predetermined distance, said catch member comprising a projection on said bar engageable with a pivoted bar urged toward said projection, and a lug on said slide bar engageable with said pivoted bar to move the same away from said projection.

6. In a selection console according to claim 5 wherein said combination further comprises a plurality of elongate parallel price bars which extend parallel to the direction of movement of said slide bar, means supporting said price bars for pivotal movement about axes parallel to said price bars, each said price bar having at least one arm extending generally normal to said axis and into the path of a said pin, a plurality of switches associated one with each price bar, each switch being actuated upon pivotal movement of the associated price bar about its axis upon movement of a said pin to engage said at least one arm, each said switch being connected separately to said solenoid to actuate said solenoid upon actuation of said switch.

7. In a selection console according to claim 1 wherein said pins are each supported by a push button biased to a first position and supported for movement along an axis parallel to the path of movement of said pins toward a second position, and said pins project from said buttons in a direction normal to said axis.

8. In a selection console according to claim 7, the combination wherein said actuating member comprises a bar pivoted on the pivot axis of said pawls and having an ear on said bar positioned between said pawls at a position between said axis and said slide bar, means for moving said ear upon movement of a said push button from said first position toward said second position to pivot said one pawl to permit movement of said slide bar in said one direction and to shift said pawls upon said button reaching said second position.

9. In a selection console according to claim 7 the combination wherein said pins extend diametrically through said buttons and one end of each pin projects through a said slot in said slide bar and the other end projects through a frame member having aligned parallel slots and wherein a plurality of individual shiftable locking elements are disposed in said frame member with adjacent edges normally aligned with said parallel slots, and spring means for maintaining said elements together and with said edges aligned with said slots whereby separation of two of said edges by a said pin moves the other of said elements across said parallel slots to lock other pins against movement.

10. In a selection console according to claim 2 wherein said combination further comprises locking bar means for restricting the return movement of a said pin and for restricting movement of another of said pins in said one direction upon the movement of said actuating member to pivot said one pawl.

11. In a selection console according to claim 3, the combination further comprising an elongate locking bar extending parallel to said slide bar and being movable about a longitudinal axis into the paths of movement of said pins, and said bar of said actuating member having a plate engageable with said locking bar upon movement of said bar about said pivot axis to move said locking bar about said longitudinal axis into the paths of said pins upon movement of said ear on said bar for restricting return movement of a said pin until said slide bar has moved a predetermined distance and for simultaneously restricting movement of another of said pins in its said path.

* * * * *